United States Patent [19]

Steinkruger et al.

[11] Patent Number: 5,057,269

[45] Date of Patent: Oct. 15, 1991

[54] PRODUCTION OF ALUMINUM-26

[75] Inventors: Fred J. Steinkruger; Dennis R. Phillips, Los Alamos, both of N. Mex.

[73] Assignee: The United States of America as represented by the United States Department of Energy, Washington, D.C.

[21] Appl. No.: 628,125

[22] Filed: Dec. 17, 1990

[51] Int. Cl.[5] ..... G21G 1/10

[52] U.S. Cl. ..... 376/192; 376/194; 376/195; 423/111

[58] Field of Search ..... 376/192, 194, 195, 196, 376/197, 198; 423/249, 111

[56] References Cited

PUBLICATIONS

Kimberly W. Thomas, "Production of Microcurie Amounts of Carrier-Free $^{26}$Al," RadioChimica Acta 33, 213–215 (1983).

*Primary Examiner*—Brooks H. Hunt
*Assistant Examiner*—Frederick H. Voss
*Attorney, Agent, or Firm*—Richard J. Cordovano; Paul D. Gaetjens; William R. Moser

[57] ABSTRACT

A method of producing Al-26 from potassium chloride by exposing it to a proton beam in order to break potassium and chlorine atoms into smaller pieces, which include Al-26. The Al-26 is isolated from the potassium chloride and other substances produced by the beam by means of extraction and ion exchange.

4 Claims, 3 Drawing Sheets

PRODUCTION OF ALUMINUM-26

This invention related to the fields of nuclear chemistry and radiochemistry. This invention is the result of a contract with the Department of Energy (Contract No. W-7405 W-7405-ENG-36).

BACKGROUND OF THE INVENTION

The isotope of aluminum having an atomic weight of 26 (Al-26) is useful in nuclear medicine and environmental chemistry. It is currently being used in research on Alzheimer's Disease and acid rain. The most readily available radioisotope of aluminum, which has an atomic weight of 28, has a half life of 2.3 minutes and is therefore not suitable for long term research. The half life of Al-26 is about $7.3\times10^5$ years. Al-26 is produced at Los Alamos National Laboratory by proton spallation reactions using a silicon target. This process requires a very long irradiation time and difficult chemistry to separate Al-26 from other spallation products. This process is described in a paper entitled "Production of Microcurie Amounts of Carrier-Free Al-26", Radiochimica Acta 33, 213–215 (1983).

In the practice of the present invention, aluminum-26 is produced by spallation reactions by exposing potassium chloride to a proton beam. The proton beam used in the present invention is produced at the Meson Physics Facility of Los Alamos National Laboratory. The proton accelerator can deliver a beam of protons at an intensity of 1 milliamp and an energy of 800 MeV. Although a wide variety of studies take place in this facility, only a portion the total proton beam is depleted by the experiments. Over three fourths of the beam remains unused at the end of the experiments and continues toward the beam stop. Immediately in front of the beam stop is an isotope production facility that uses the proton beam to create radioisotopes from various target materials.

A spallation reaction occurs when an accelerated proton from the 800 MeV beam strikes the nucleus of a target atom and causes fragments of various sizes and energies to be ejected. Al-26 is one of these fragments. KCl was chosen as the target material because the larger spallation products are typically about ten to fifteen atomic units lighter from the starting materials, thus favoring production of fragments having an atomic weight of 26. Potassium has an atomic weight of 39 and that of chlorine is 34.45. The spallation process generates extremely high radiation levels and raises the temperatures of the targets to values as high as 1000° C., even though they are water cooled during exposure to the beam. Irradiated targets must be handled by means of the usual methods for radioactive substances. Separation of Al-26 from the target and other fragments of the spallation reactions takes place in an isolated and shielded location called a hot cell. The work is done by means of remotely controlled mechanical manipulators behind an 18 inch thick leaded glass window.

SUMMARY OF THE INVENTION

This invention is a method of producing Al-26 from potassium chloride by exposing it to a proton beam in order to break potassium and chlorine atoms into smaller pieces, which include Al-26. The Al-26 is isolated from the potassium chloride and substances produced by the beam by mean of extraction and ion exchange.

BRIEF SUMMARY OF THE DRAWINGS

FIG. 1 depicts a method of dissolution which is used when aluminum-26 in an irradiated KCl target is insoluble in water or hydrochloric acid FIG. 2 depicts an extraction method which is used when aluminum-26 in an irradiated KCl target is soluble in HCl.

FIG. 3 depicts an ion exchange procedure which is used to produce pure Al-26 after the Al-26 is separated from the irradiated KCl target by the method of FIG. 1 or the method of FIG. 2.

DETAILED DESCRIPTION OF THE INVENTION

In experimentation involving the present invention, a single KCl target was exposed to the proton beam. The target weighed 94 g and was contained in a stainless steel container constructed from a 1 inch length of stainless steel pipe. Stainless steel plates were welded to each end of the pipe and a one half inch diameter fill hole was drilled in the container through which 94 g of molten KCl was poured into the container. After the container was filled, it was sealed by welding a stainless steel plug in the fill hole. The container was placed into an aluminum box which was placed in the path of the proton beam. Cooling water was circulated through the aluminum box to cool the KCl during irradiation. The target was exposed to the proton beam for 744.3 hours and the average beam current for the exposure was 775 microamps. The target was exposed to a total of 576,853 microamp-hours and $1.3\times10^{22}$ protons It is estimated that about two microcuries of aluminum-26 were produced. A curie is the amount of a radioactive substance that undergoes $3.7\times10^{10}$ radioactive disintegrations per second. The mass of 2 microcuries of Al-26 is about 104 micrograms. The current selling price of Al-26 is about $30,000.00 per microgram.

Figure 1:
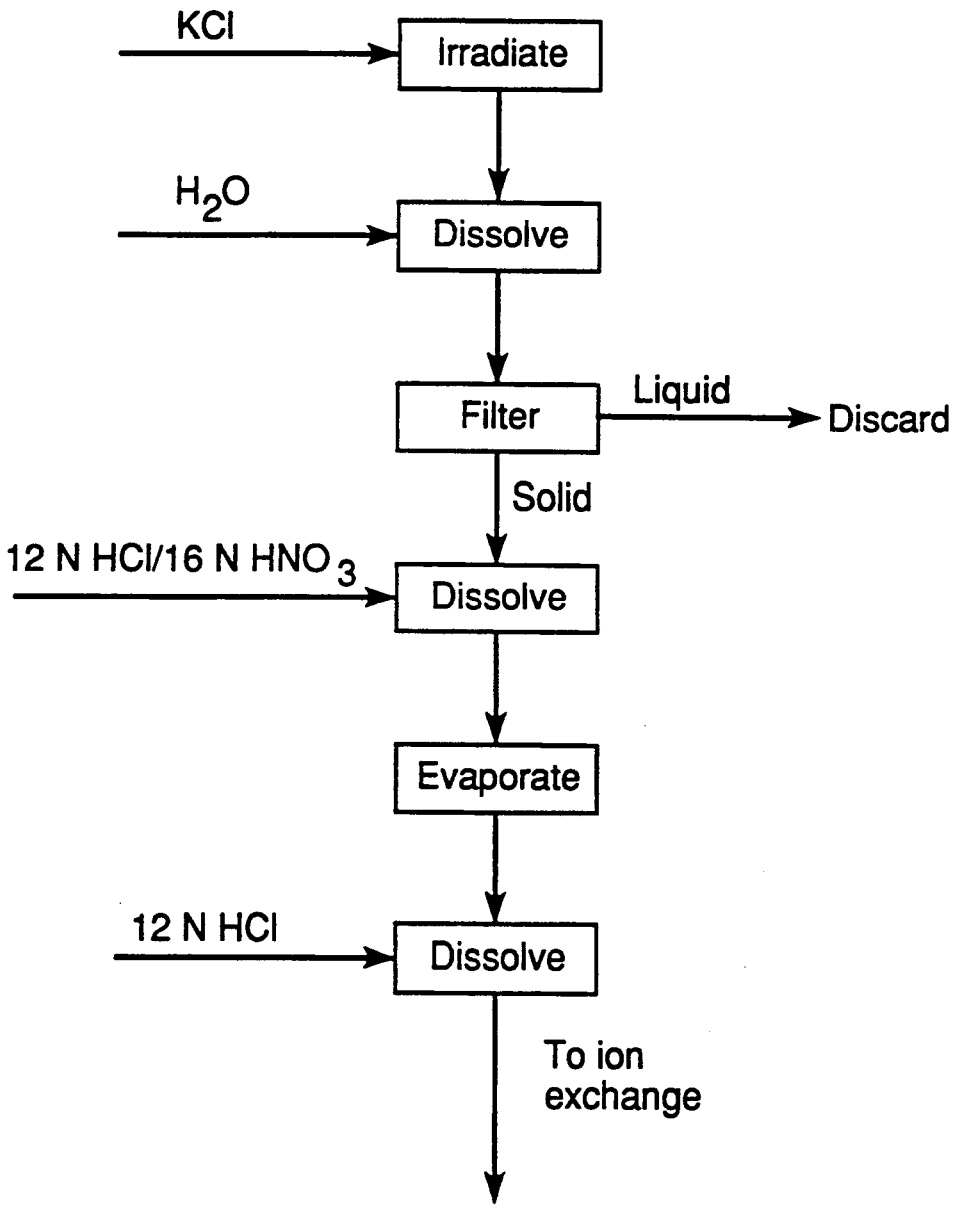
FIGS. 1, 2 and 3 are block diagrams of the inventive process, where each block indicates that a particular function is accomplished.

Referring to FIG. 1, the irradiated target was removed from the container and mixed with water. The mixture was filtered using a coarse-fritted Gooch funnel. Analysis of the liquid showed there was no Al-26 in the filtrate. The Gooch funnel was soaked in a heated mixture of 12 N hydrochloric acid and 16 N nitric acid where the ratio of hydrochloric to nitric was 5 to 1 by volume in order to recover the insoluble residue from the glass frit. After the residue was dissolved, the liquid was evaporated to dryness and the residue remaining after evaporation was dissolved in 12 N hydrochloric acid. The resulting solution was subjected to an ion exchange procedure, which will be described below, in order to isolate pure Al-26. The procedure described in this paragraph is depicted in FIG. 1.

Figure 2:
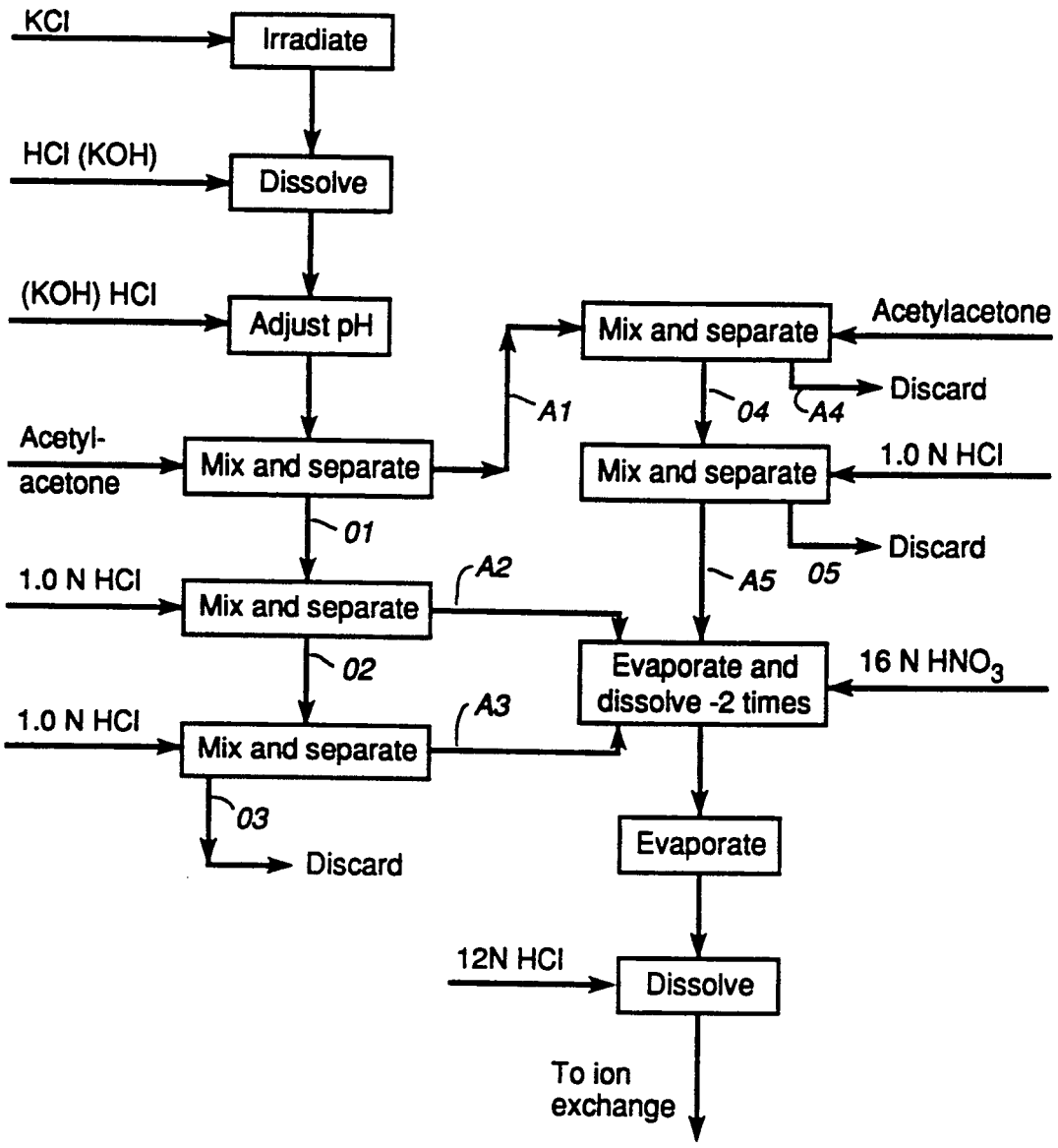

It is believed that the Al-26 in an irradiated target can be dissolved in hydrochloric acid. That the Al-26 formed in the irradiated target was insoluble in water may be because it was in the form of aluminum oxide, which is soluble in hydrochloric acid. Also, there is the possibility that the irradiated target will be soluble in potassium hydroxide. If this is so, as shown in the parentheses at the second box from the top of FIG. 2, hydrochloric acid will be used to adjust the pH to a value of 6, as shown in parentheses at the third box of FIG. 2, instead of KOH, as stated in the following paragraph. It is to be noted that the chemistry of very small quantities of substances is often different from that of the substances in larger amounts. An extraction procedure was developed to avoid the filtration step described above, in which a portion of the Al-26 is lost in the filter. This procedure is shown in FIG. 2 and was developed using non-radioactive materials. The procedure is as follows.

Potassium chloride in an amount of 93 g was dissolved in 350 ml of water. Aluminum chloride solution in an amount corresponding to the amount of Al-26 expected to be formed by the spallation reactions was added to the KCl solution. Potassium hydroxide was added to the solution to adjust the pH to a value of 6. The solution was then mixed with 60 ml of acetylacetone and the resulting two phases were separated into a first organic phase and a first aqueous phase. The first organic phase was back-extracted by mixing it with 30 ml of 1.0 normal hydrochloric acid and the mixture separated into a second aqueous phase and a second organic phase. Note that FIG. 2 has notations such as, for example, 01 and Al; these mean first organic phase and first aqueous phase. In a second back-extraction, the second organic phase was mixed with 30 ml of 1.0 normal hydrochloric acid and separated into a third aqueous phase and a third organic phase, which was discarded.

The first aqueous phase was mixed with 60 ml of acetylacetone and separated into a fourth organic phase and a fourth aqueous phase, which was discarded. The fourth organic phase was back-extracted by mixing it with 30 ml of 1.0 normal hydrochloric acid and separating the mixture into a fifth aqueous phase and a fifth organic phase, which was discarded. The second, third and fifth aqueous phases were combined and evaporated to dryness. Nitric acid of 16 N concentration was added to the residue and the resulting solution was evaporated to dryness in order to remove traces of the organic extracting agent. Again, 16 N nitric acid was added to the residue from this evaporation and the resulting solution evaporated to dryness. The residue was dissolved in 12 N hydrochloride acid, thus providing a solution which can be subjected to an ion exchange procedure to yield pure Al-26. After initial development of the extraction procedure, it was carried out using radioactive tracers.

Figure 3:
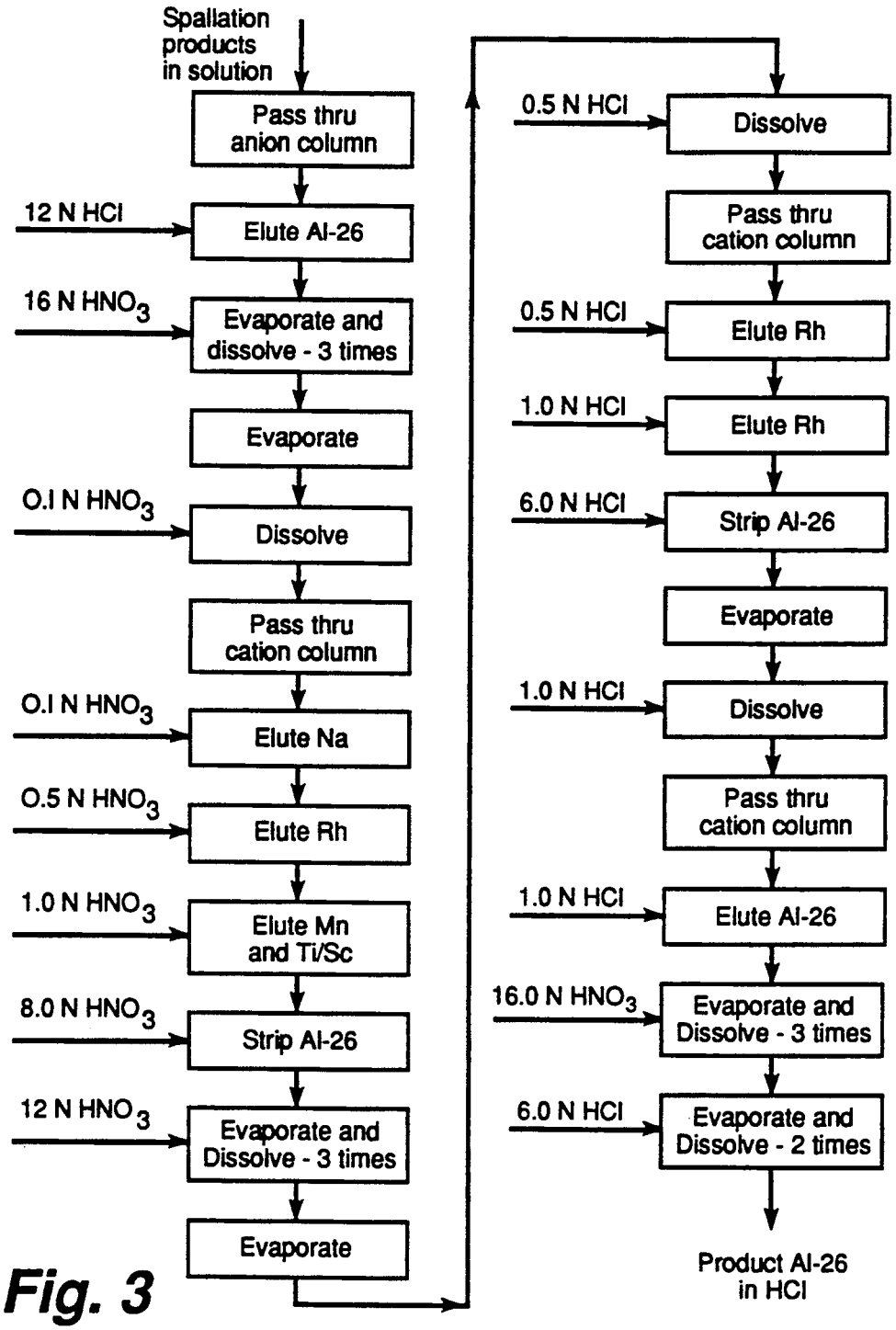

The ion exchange procedure is shown in FIG. 3; the solution of Al-26 obtained by the method shown in FIG. 1 was subjected to this procedure. The solution contained sodium-22 which was produced by the spallation reactions and also contained a number of substances which were formed from the stainless steel of the container interacting with the proton beam. These substances were cobalt-57, cobalt-60, manganese-54, rhodium-101, rhodium-102, selenium-75, titanium-44/scandium-44, yttrium-88. Scandium is a short-lived daughter of titanium. Also, present were iron and copper from the stainless steel container.

The solution was passed through an anion exchange column filled with AG 1-X8 anion exchange resin of 200 to 400 mesh size in order to remove iron. Selenium and cobalt were also removed. The ion exchange resins used herein were polymer based resins and were obtained from Biorad Laboratories of Richmond, CA. The Al-26 and remaining impurities were eluted from the column by passing 12 N hydrochloric acid through it until analysis by gamma ray spectroscopy showed no Al-26 in the eluate. The chlorides in the resulting solution were converted to nitrates by evaporating to dryness, redissolving in 16 N nitric acid, repeating this procedure two more times, and then dissolving the residue from a final evaporation to dryness in 0.1 N nitric acid.

This nitric acid solution was passed through a cation exchange column containing AG 50W-X8 cation exchange resin. The resin particles ranged from 200 to 400 mesh in size. Sodium and rhodium were eluted from the column by washing with 0.1 normal nitric acid until the stream leaving the column contained no sodium, as determined by gamma ray spectroscopy. The column was then washed with 0.5 normal nitric acid in order to remove additional rhodium until the amount of rhodium in the eluate reached a constant minimum amount. The column was then washed with 1.0 normal nitric acid in order to remove manganese and titanium/scandium. Copper and more rhodium also came off the column. Finally, 8.0 normal nitric acid was passed through the column in order to strip Al-26 from the column. Rhodium and yttrium also came off. The resulting solution was evaporated to dryness and dissolved in 12 N HCl in order to convert the nitrates to chlorides.

Evaporation and the redissolution was repeated 3 more times with the residue being dissolved in 0.5 N HCl after the last evaporation. The resulting solution was passed through a cation exchange column filled with AG 50W-X8 cation exchange resin of 200–400 mesh. Elution of rhodium from the column was accomplished by washing the column with 0.5 N hydrochloric acid and then 1.0 N hydrochloric acid in sequence. The column was washed until rhodium could not be detected in the wash stream leaving the column, as indicated by gamma ray spectroscopy. The column was stripped of Al-26 and yttrium by passing 6.0 normal hydrochloric acid through the column. The resulting eluate was evaporated to dryness and redissolved in 1.0 N hydrochloric acid. The solution was passed through a cation exchange column filled with AG 50-X4 cation exchange resin of 100–200 mesh. Al-26 was eluted from the column by washing with 1.0 N hydrochloric acid. The resulting solution was evaporated to dryness and dissolved in 16 N nitric acid three times in order to remove all traces of organic material picked up from the ion exchange resins. Finally, the solution was evaporated to dryness once more and then dissolved in 6.0 N hydrochloric acid to obtain a solution containing substantially pure aluminum-26. This is the form in which it is distributed to users.

It is expected that a proton beam having an energy of a minimum of 100 MeV is needed to initiate the spallation reactions which produce Al-26. The rate at which Al-26 is formed is related to the intensity of the beam, so that longer exposure times are required as beam intensity is decreased.

Information on the use and characterization of ion exchange resins can be found in material presented by Kraus and Nelson in "Proceedings of the First United Nations International Conference on the Peaceful Uses of Atomic Energy" (volume 7, 1956) and "CRC Handbook of Ion Exchange Resins: Their Application to Inorganic Analytical Chemistry" by Johann Korkish (CRC Press; Boca Raton, Florida; 1989). The first reference contains distribution coefficient data. Note that the codes which are used herein to identify the ion exchange resins used in the process are not manufacturers identification numbers but are universal designators which specify the characteristics of the resins.

In addition to acetylacetone, there are other organic extracting agents which may be used to extract aluminum from aqueous solutions; these are known to those skilled in the art.

What is claimed is:

1. A method for producing an aluminum isotope having an atomic weight of about 26 comprising:

a. exposing potassium chloride to a proton beam of sufficient energy to cause spallation of the potassium chloride for a time period sufficient for said spallation to take place;

b. dissolving said exposed potassium chloride and spallation products in hydrochloric acid or potassium hydroxide;

c. adjusting the pH of the solution from step b to about 6.0 using potassium hydroxide or hydrochloric acid;

d. mixing the solution from step c with an organic extracting agent and then separating the mixture into a first organic phase and a first aqueous phase;

e. subjecting said first organic phase to at least one back-extraction with hydrochloric acid and discarding the organic phase;

f. mixing said first aqueous phase with an organic extracting agent, separating the mixture into a second organic phase and an aqueous phase and discarding the aqueous phase;

g. subjecting said second organic phase to at least one back-extraction with hydrochloric acid and discarding the organic phase;

h. combining said aqueous phases from said back-extractions;

i. evaporating said combined aqueous phases to dryness and redissolving at least once in 16 N nitric acid;

j. evaporating the solution from step i to dryness and redissolving at least once in 12 N hydrochloric acid; and k. subjecting the solution from step j to an ion exchange procedure to produce a substantially pure solution of Al-26.

2. The ion exchange procedure of claim 1 wherein step K comprises.

a. passing the solution from step 1.j through anion exchange resin AG 1-X8(200–400 mesh);

b. removing Al-26 from said anion resin by passing 12 N hydrochloric acid through said anion resin;

c. evaporating the eluate from step b to dryness and redissolving at least once in 16 N nitric acid;

d. evaporating the solution from step c to dryness and redissolving in 0.1 N nitric acid;

e. passing the solution from step d through cation exchange resin AG 50W-X8(200–400 mesh);

f. passing 0.1 N nitric acid through said resin of step e until analysis of the eluate shows no sodium present in the eluate;

g. passing 0.5 N nitric acid through said resin of step e until analysis of the eluate shows a substantially constant minimum amount of rhodium present in the eluate;

h. passing 1.0 N nitric acid through said resin of step e until analysis shows a substantially constant minimum amount of manganese and titanium present in the eluate;

i. stripping Al-26 from said resin of step e by passing 8.0 N nitric acid through said resin;

j. evaporating the solution from step i to dryness and redissolving at least once in 12 N hydrochloric acid;

k. evaporating the solution from step j to dryness and redissolving the residue in 0.5 N hydrochloric acid;

l. passing the solution from step k through cation exchange resin AG 50W-X8(200-400 mesh);

m. passing 0.5 N hydrochloric acid through said resin of step 1 until analysis of the eluate shows a substantially minimum constant amount of rhodium present in the eluate;

n. passing 1.0 N hydrochloric acid through said resin of step 1 until analysis of the eluate shows substantially no rhodium present in the eluate;

o. stripping Al-26 from said resin of step 1 by passing 6.0 N hydrochloric acid through the resin;

p. evaporating the solution from step o to dryness and redissolving in 1.0 N hydrochloric acid;

q. passing the solution from step p through cation exchange resin AG 50-X4(100–200 mesh);

r. stripping Al-26 from said resin of step q by passing 1.0 N hydrochloric acid through the resin; and s. evaporating the solution from step r to dryness and redissolving in 16 N nitric acid at least once.

3. A method for producing an aluminum isotope having an atomic weight of about 26 comprising:

a. exposing potassium chloride to a proton beam of sufficient energy to cause spallation of the potassium chloride for a time period sufficient for said spallation to take place;

b. mixing said exposed potassium chloride and spallation products with water and passing the resulting mixture through a filter;

c. dissolving the residue from said filtration in a mixture of 5 parts by volume 12 N hydrochloric acid and one part 16 N nitric acid;

d. evaporating the solution from step c to dryness and redissolving in 12 N hydrochloric acid; and e. subjecting the solution from step d to an ion exchange procedure to produce a substantially pure solution of Al-26.

4. The ion exchange procedure of claim 3 wherein step e comprises:

a. passing the solution from step 3.d through anion exchange resin AG 1-X8(200–400 mesh);

b. removing Al-26 from said anion resin by passing 12 N hydrochloric acid through said anion resin;

c. evaporating the eluate from step b to dryness and redissolving at least once in 16 N nitric acid;

d. evaporating the solution from step c to dryness and redissolving in 0.1 N nitric acid;

e. passing the solution from step d through cation exchange resin AG 50W-X8(200–400 mesh);

f. passing 0.1 N nitric acid through said resin of step e until analysis of the eluate shows no sodium present in the eluate;

g. passing 0.5 N nitric acid through said resin of step e until analysis of the eluate shows a substantially constant minimum amount of rhodium present in the eluate;

h. passing 1.0 N nitric acid through said resin of step e until analysis shows a substantially constant minimum amount of manganese and titanium present in the eluate;

i. stripping Al-26 from said resin of step e by passing 8.0 N nitric acid through said resin;

j. evaporating the solution from step i to dryness and redissolving at least once in 12 N hydrochloric acid;

k. evaporating the solution from step j to dryness and redissolving the residue in 0.5 N hydrochloric acid;

l. passing the solution from step k through cation exchange resin AG 50W-X8(200–400 mesh);

m. passing 0.5 N hydrochloric acid through said resin of step 1 until analysis of the eluate shows a substantially minimum constant amount of rhodium present in the eluate;

n. passing 1 0 N hydrochloric acid through said resin of step 1 until analysis of the eluate shows substantially no rhodium present in the eluate;

o. stripping Al-26 from said resin of step 1 by passing 6.0 N hydrochloric acid through the resin;

p. evaporating the solution from step o to dryness and redissolving in 1.0 N hydrochloric acid;

q. passing the solution from step p through cation exchange resin AG 50-X4(100–200 mesh);

r. stripping Al-26 from said resin of step q by passing 1.0 N hydrochloric acid through the resin; and s. evaporating the solution from step r to dryness and redissolving in 16 N nitric acid at least once.

* * * * *